US009192872B2

(12) United States Patent
Hakam et al.

(10) Patent No.: US 9,192,872 B2
(45) Date of Patent: Nov. 24, 2015

(54) APPARATUS FOR SEALING AND ILLUMINATING A BALLOON

(71) Applicant: Cool Glow LLC, Coppell, TX (US)

(72) Inventors: Hunaid Hakam, Dallas, TX (US); Glenna Morgio, Dallas, TX (US)

(73) Assignee: Cool Glow LLC, Coppell, TX (US)

( * ) Notice: Subject to any disclaimer, the term of this patent is extended or adjusted under 35 U.S.C. 154(b) by 0 days.

(21) Appl. No.: 14/477,343

(22) Filed: Sep. 4, 2014

(65) Prior Publication Data

US 2015/0060599 A1 Mar. 5, 2015

Related U.S. Application Data

(60) Provisional application No. 61/874,067, filed on Sep. 5, 2013.

(51) Int. Cl.

| | |
|---|---|
| ***F21L 4/00*** | (2006.01) |
| ***F21V 25/00*** | (2006.01) |
| ***F21V 31/00*** | (2006.01) |
| ***A63H 27/10*** | (2006.01) |
| ***F21V 3/02*** | (2006.01) |

(52) U.S. Cl.

CPC ..... *A63H 27/10* (2013.01); *F21V 3/023* (2013.01); *A63H 2027/1033* (2013.01); *A63H 2027/1041* (2013.01); *A63H 2027/1058* (2013.01)

(58) Field of Classification Search

CPC ..... A63H 27/10; A63H 27/1033; A63H 27/1041; A63H 27/1058; F21V 3/023; F21V 3/026

USPC ..... 362/158, 190–191, 253, 457–458

See application file for complete search history.

(56) References Cited

U.S. PATENT DOCUMENTS

| | | | |
|---|---|---|---|
| 7,344,267 | B2 | 3/2008 | Carito |
| 7,478,779 | B2 | 1/2009 | Nguyen et al. |
| 7,850,328 | B2 | 12/2010 | Carito |
| 7,922,116 | B2 | 4/2011 | Nguyen et al. |

*Primary Examiner* — Jason Moon Han

(74) *Attorney, Agent, or Firm* — James L. Baudino

(57) ABSTRACT

An apparatus for sealing and illuminating a balloon includes: a body element insertable into an opening of a balloon, the body element enabling inflation of the balloon through an intake tube thereof; a light module for illuminating an interior of the balloon; and a sealing element having a first end couplable to the body element and a second end extending freely from the body element, the second end of the sealing element sealable below the intake tube to prevent deflation of the balloon.

17 Claims, 4 Drawing Sheets

APPARATUS FOR SEALING AND ILLUMINATING A BALLOON

BACKGROUND

There are many types of light up objects and types of novelty items, such as headgear, necklaces, bracelets, drinking cups, etc. These types of devices are popular gift items and oftentimes may be found at amusement parks, parties and other types of social events. Another type of item is a device that is inserted into a balloon that illuminates the balloon from the inside of the balloon. These devices may contain a light emitting diode (LED) and a power source (battery) for powering the LED. The device is generally inserted into a neck of the balloon so that the LED is within the balloon. A switch may then be actuated to cause the LED to illuminate the balloon from within the balloon.

BRIEF SUMMARY

According to one aspect of the present disclosure, an apparatus for sealing and illuminating a balloon is disclosed. The apparatus comprises: a body element insertable into an opening of a balloon, the body element enabling inflation of the balloon through an intake tube thereof; a light module for illuminating an interior of the balloon; and a sealing element having a first end couplable to the body element and a second end extending freely from the body element, the second end of the sealing element sealable below the intake tube to prevent deflation of the balloon.

BRIEF DESCRIPTION OF THE SEVERAL VIEWS OF THE DRAWINGS

For a more complete understanding of the present application, the objects and advantages thereof, reference is now made to the following descriptions taken in conjunction with the accompanying drawings, in which.

DETAILED DESCRIPTION

Embodiments of the present disclosure provide an apparatus for sealing and illuminating a balloon. The apparatus comprises: a body element insertable into an opening of a balloon, the body element enabling inflation of the balloon through an intake tube thereof; a light module for illuminating an interior of the balloon; and a sealing element having a first end couplable to the body element and a second end extending freely from the body element, the second end of the sealing element sealable below the intake tube to prevent deflation of the balloon.

Figure 1:
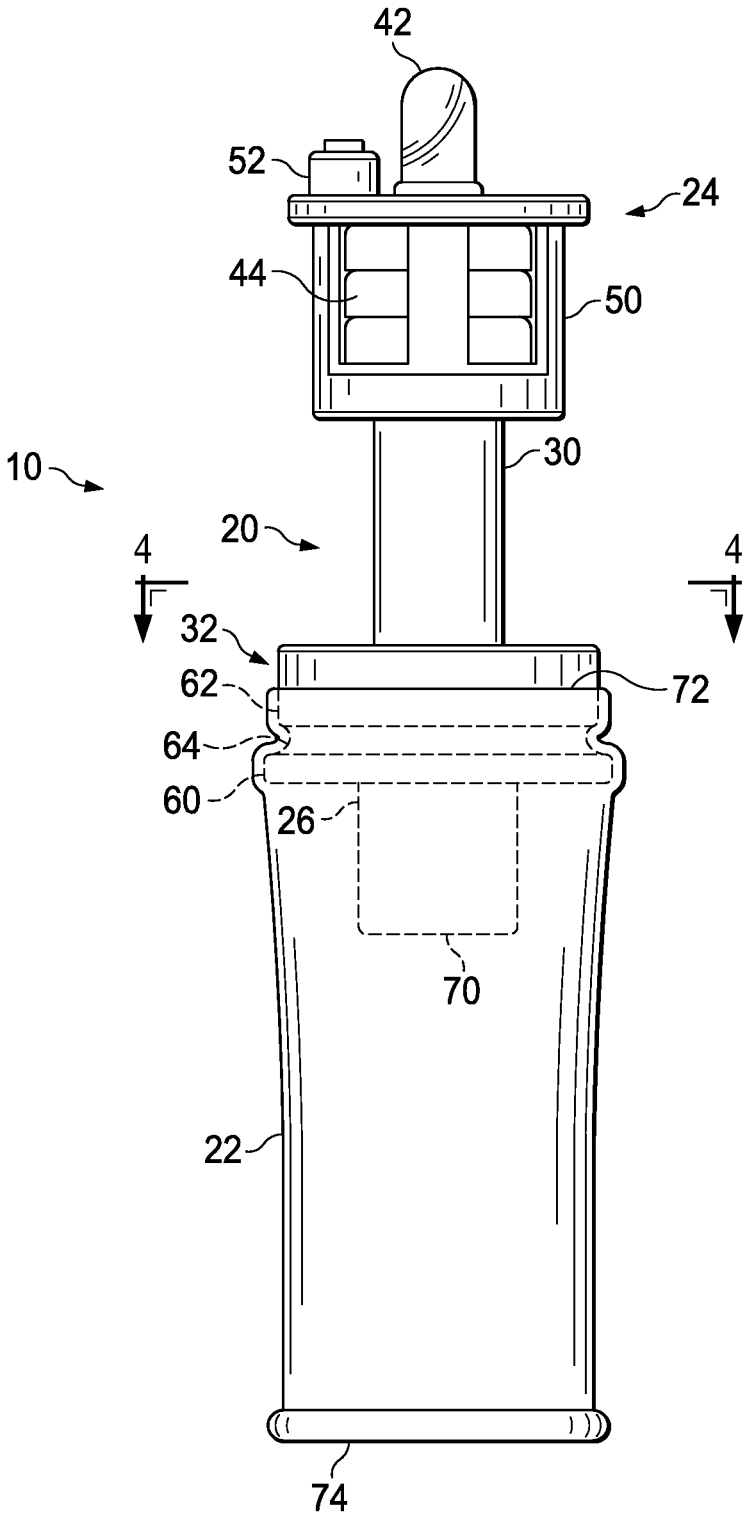
FIG. 1 is a diagram illustrating an embodiment of an apparatus for sealing and illuminating a balloon according to the present disclosure.
Figure 2:
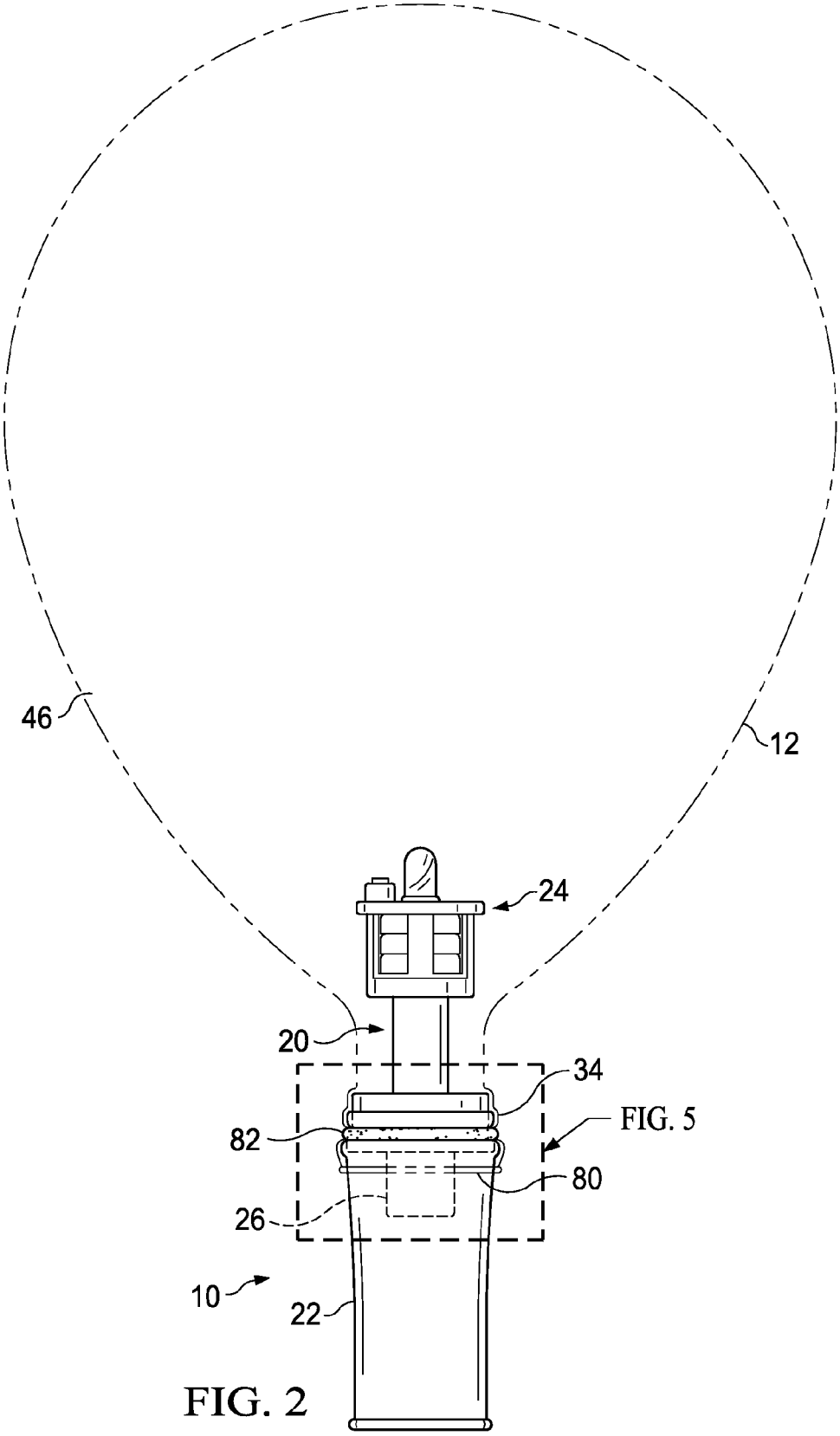
FIG. 2 is a diagram illustrating the apparatus of FIG. 1 with a balloon secured to the apparatus according to the present disclosure.
Figure 3:
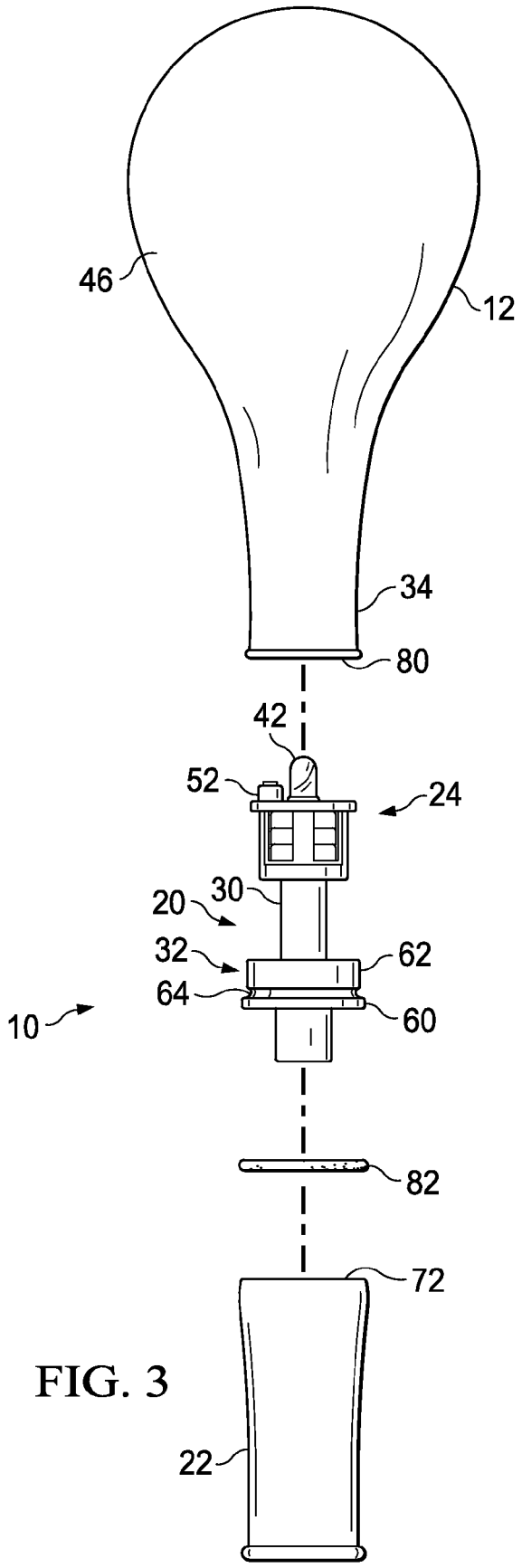
FIG. 3 is a diagram illustrating an exploded view of the apparatus and balloon of FIG. 2 according to the present disclosure.
Figure 4:
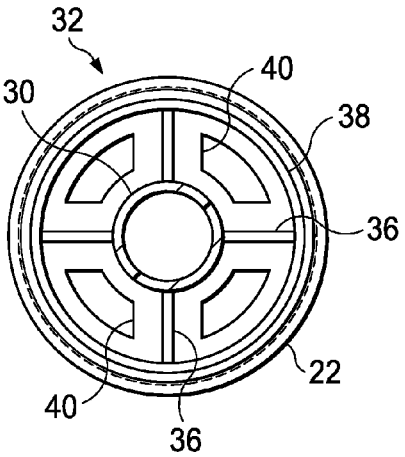
FIG. 4 is a diagram illustrating a section view of apparatus 10 taken along the line 4-4 of FIG. 1.

With reference now to the Figures and in particular with reference to FIGS. 1-4, exemplary diagrams of an apparatus 10 for sealing and illuminating a balloon 12 according to the present disclosure are provided. FIG. 1 is a diagram illustrating an embodiment of apparatus 10 according to the present disclosure, FIG. 2 is a diagram illustrating apparatus 10 of FIG. 1 with balloon 12 secured thereto, and FIG. 3 is a diagram illustrating an exploded view of apparatus 10 and balloon. FIG. 4 is a diagram illustrating a section view of apparatus 10 taken along the line 4-4 of FIG. 1. In the embodiment illustrated in FIGS. 1-4, apparatus 10 comprises a body element 20 and a sealing element 22. Body element 20 includes a light module 24 at one end thereof and an intake tube 26 at an opposite end thereof. Body element 20 also includes a support 30 depicted as a substantially circular, hollow, elongate member (e.g., a cylindrical member); however, it should be understood that support 30 may be configured having other shapes and configurations (e.g., an elongate conical shape, elliptical, square, rectangular, solid, etc.). Support 30 is disposed between light module 24 and a sealing portion 32 of body element 20 to distally locate light module 24 from sealing portion a desired distance to facilitate placement of light module 24 a sufficient distance into balloon 12 to increase illumination of balloon 12. As will be described in greater detail below, sealing portion 32 is configured to sealingly engage a portion or neck 34 of balloon 12.

As best illustrated in FIG. 4, the interface of support 30 and sealing portion 32 includes a number of struts 36 extending from support 30 toward an outer wall 38 of sealing portion 32. Between struts 36 are a number of interior openings 40 in gasflow communication with intake tube 26. In FIG. 1, openings 40 enable filling of balloon 12 with a gas (e.g., air, helium, etc.) after insertion of apparatus 10 into balloon 12. For example, a gasflow entering intake tube 26 may pass through openings 40 and into balloon 12.

Light module 24 comprises one or more light elements 42 (e.g., light emitting diodes (LEDs)) powered by an onboard power supply 44, such as replaceable or non-replaceable batteries. In the illustrated embodiment, power supply 44 is located within a housing 50 located between light elements 42 and support 30 (e.g., located within interior area 46 of balloon 12 when apparatus 10 is inserted into balloon 12). However, it should be understood that power supply 44 may be otherwise located on apparatus 10. Light module 24 is insertable into balloon 12 such that light elements 42 are located within in interior area 46 of balloon 12. In some embodiments, light module 24 may comprise a plurality of light elements 42 of a number of different colors. In the illustrated embodiment, light module 24 is located at a distal end of support 30 relative to sealing portion 32 or intake tube 26. However, it should be understood that light module 24 may be otherwise located on apparatus 10. In the illustrated embodiment, light elements 42 face/extend upwards away from body element 20 to create evenly dispersed light throughout balloon 12. Light elements 42 may include any number and/or color of lights.

Light module 24 may also include an activation switch 52 for controlling various aspects of light module 24. For example, light module 24 may include a sound or voice chip used to illuminate light elements 42 by means of sound or voice activation. Activation switch 52 may be used to turn light module 24 (e.g., light elements 42) on/off. Activation switch 52 may also control the illumination of light elements 42 using the sound/voice chip. Activation switch 52 may also control a variety of other functions including, but not limited to: controlling what colors are illuminated, controlling which light elements 42 are illuminated, and controlling the speed and/or pattern of the light element 42 illumination/deactivation. In the illustrated embodiment, a single activation switch 52 is depicted; however, it should be understood that additional switches may be provided to control different features. Further, in the illustrated embodiment, activation switch 52 is located adjacent light elements 42 such that activation switch 52 is located within interior area 46 of balloon 12 when apparatus 10 is inserted into balloon 12. Activation switch 52 may be activated before or after insertion of apparatus 10 into balloon 12. However, activation switch 52 may be otherwise located on apparatus 10.

In the illustrated embodiment, sealing portion 32 comprises a circular configuration extending outwardly to a greater distance or diameter than intake tube 26 and/or support 30 to enable sealing portion 32 to sealably engage neck 34 of balloon 12. In the illustrated embodiment, sealing portion 32 comprises flanges 60 and 62 having an annular recess 64 disposed therebetween. In the illustrated embodiment, flange 60 is sized slightly greater than flange 62 to enable a greater/tighter seal of flange 60 with neck 34 of balloon 12; however, it should be understood that flanges 60 and 62 may be similarly configured or have flange 62 sized greater than flange 60. In the illustrated embodiment, intake tube 26 extends from beyond an end of sealing portion 32 in a direction opposite from support 30.

Sealing element 22 is configured to be attachable/couplable to and/or over a portion of sealing portion 32 such that sealing element 22 extends beyond a gasflow entry end 70 of intake tube 26 to prevent a gas from exiting balloon 12 after inflation of balloon 12. For example, sealing element 22 may be configured as a tube having oppositely disposed open ends 72 and 74 such that end 72 may be slid onto body element 20 and extend over a portion of sealing portion 32 (e.g., extending over flange 60 and recess 64 to at least a portion of flange 62). In some embodiments, sealing element 22 is formed from a flexible material and sized smaller that a size of sealing portion 32 such that sealing element 22 may be stretched/expanded to slide over sealing portion 32 to thereby create a seal between sealing element 22 (near end 70) and sealing portion 32. For example, sealing element 22 may be formed from latex, rubber, polychloroprene, nylon fabric, etc. In the illustrated embodiment, sealing element 22 is configured to extend freely beyond end 70 of intake tube 26 when secured to sealing portion 32. For example, sealing element 22 is configured having a length to enable a portion of sealing element 22 extending beyond intake tube 26 to be closed and/or sealed. End 74 may remain open until after balloon 12 has been inflated, and then closed/sealed/tied to prevent deflation of balloon 12.

In operation, the open neck 34 of balloon 12 may be slid over body element 20 (e.g., from the end of body element 20 having light module 24) until at least a portion of the open end 80 of balloon 12 extends onto sealing portion 32. In the illustrated embodiment, a portion of balloon 12 will also extend over a portion of sealing element 22 (e.g., at least in the area of the sealing portion 32). However, it should also be understood that, alternatively, balloon 12 may be attached to body element 20 before sealing element 22 is attached to body element 20. In some embodiments, body element 20 and/or intake tube 26 is sized such that the open end 70 of intake tube 26 extends downwardly below and beyond the end 80 of balloon 12.

Figure 5:
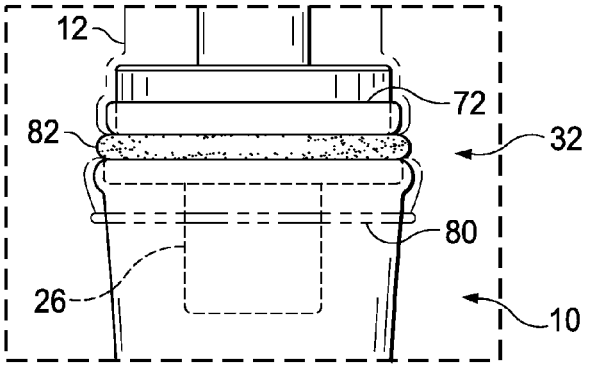
FIG. 5 is a diagram illustrating an enlarged view of a portion of the apparatus and balloon indicated by view line/box 5 in FIG. 2 according to the present disclosure.
Figure 6:
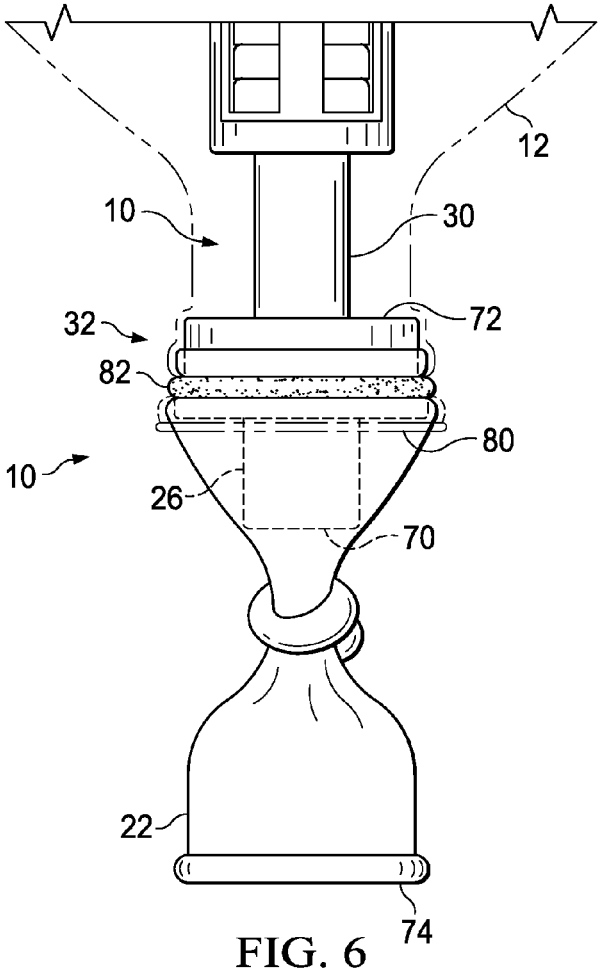
FIG. 6 is a diagram illustrating an enlarged view of a portion of the apparatus and balloon with the apparatus sealed according to the present disclosure.

Referring also to FIGS. 5 and 6, in some embodiments, an additional sealing element 82 (e.g., a rubber gasket, O-ring, or other type of flexible and/or elastic element) may be placed over body element 20 and over balloon 12/sealing element 22 to further secure balloon 12/sealing element 22 to body element 20 and further prevent deflation of balloon 12. FIG. 5 is a diagram illustrating an enlarged view of a portion of apparatus 10 and balloon 12 taken from view line/box 5 of FIG. 2, and FIG. 6 is a diagram illustrating a same portion of apparatus 10 and balloon 12 after sealing/closing of sealing element 22. In the illustrated embodiment, sealing element 82 is placed over body element 20 in the area/location of recess 64 such that recess 64 comprises a concave area for receiving and/or seating sealing element 82 therein. Thus, in the illustrated embodiment, sealing element 82 applies a sealing pressure against sealing element 22 and balloon 12 relative to body element 20 (e.g., securing portion 32).

Thus, in some embodiments, in operation, sealing element 22 may first be secured to body element 20. Thereafter, balloon 12 may be slid over body element 20 from an opposite end of sealing element 20. Portions of sealing element 22 and balloon 12 extend/overlap each other in the area of sealing portion 32. Sealing element 82 may then be placed over the portion of balloon 12 and sealing element 22 in the area of sealing portion 32 until sealing element 82 resides in recess 64. Balloon 12 may then be inflated by injecting/providing a gasflow into end 70 of intake tube 26. The gasflow travels into intake tube 26 and exits openings 40 to inflate balloon 12. Once balloon 12 is inflated, sealing element 22 may be tied, closed and/or otherwise sealed. Light module 24 may be activated to illuminate balloon 12.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. An apparatus for sealing and illuminating a balloon, comprising:

a body element insertable into an opening of a balloon, the body element enabling inflation of the balloon through an intake tube thereof;

a light module for illuminating an interior of the balloon; and a sealing element having a first end couplable to the body element and a second end extending freely from the body element, the second end of the sealing element sealable below the intake tube to prevent deflation of the balloon by tying the second end thereof.

2. The apparatus of claim 1, further comprising another sealing element couplable to the body element over the balloon.

3. The apparatus of claim 1, wherein a portion of the sealing element and a portion of the balloon extend over each other in a sealing portion of the body element.

4. The apparatus of claim 1, wherein the sealing element comprises a first sealing element, and further comprising a second sealing element, the first sealing element disposed between the body element and the second sealing element.

5. The apparatus of claim 4, wherein a portion of the balloon is disposed between the body element and the second sealing element.

6. The apparatus of claim 1, wherein the light module comprises a light element and a power supply, and wherein a sealing portion of the body element comprises an opening for passing an airflow received from the intake tube to an interior of the balloon, the sealing portion for sealingly engaging a portion of the balloon, and wherein a support distally locates the power supply from the sealing portion.

7. The apparatus of claim 6, wherein the sealing portion is located between the intake tube and the support.

8. The apparatus of claim 6, further comprising an activation switch for activating the light element, the activation switch located adjacent the light element and disposed within the interior of the balloon.

9. The apparatus of claim 8, wherein the power supply is located between the activation switch and the support.

10. An apparatus for sealing and illuminating a balloon, comprising:

a body element comprising:

a sealing portion for sealingly engaging a portion of a balloon;

an intake tube at a first end thereof for receiving a gas-flow to inflate the balloon; and a light element at a second, opposite end thereof for illuminating an interior area of the balloon; and a sealing element having a first end couplable to the sealing portion and a second end extending beyond an airflow intake end of the intake tube, the second end of the sealing element sealable below the intake tube to prevent deflation of the balloon, wherein the sealing element comprises a flexible tube closable over the airflow intake end of the intake tube.

11. The apparatus of claim 10, wherein a portion of the sealing element and a portion of the balloon overlap each other on the sealing portion.

12. The apparatus of claim 10, further comprising another sealing element couplable to the body element over the balloon.

13. The apparatus of claim 10, wherein the sealing element comprises a first sealing element, and further comprising a second sealing element, the first sealing element disposed between the body element and the second sealing element.

14. The apparatus of claim 13, wherein the sealing portion comprises a recess for seating the second sealing element therein.

15. The apparatus of claim 14, wherein a portion of the balloon is disposed between the body element and the second sealing element.

16. The apparatus of claim 10, wherein the sealing portion comprises an interior opening in airflow communication with the intake tube.

17. The apparatus of claim 16, further comprising a support disposed between the sealing portion and the light element to distally locate the light element from the sealing portion.

* * * * *